US008500484B2

(12) United States Patent
Hu

(10) Patent No.: US 8,500,484 B2
(45) Date of Patent: Aug. 6, 2013

(54) MOVABLE CONNECTION METHOD OF SOCKET AND ROTARY SOCKET THEREOF

(76) Inventor: Kan Hu, Zhejiang (CN)

( * ) Notice: Subject to any disclaimer, the term of this patent is extended or adjusted under 35 U.S.C. 154(b) by 112 days.

(21) Appl. No.: 13/318,703

(22) PCT Filed: May 4, 2010

(86) PCT No.: PCT/CN2010/072408

§ 371 (c)(1),
(2), (4) Date: Nov. 21, 2011

(87) PCT Pub. No.: WO2010/127606

PCT Pub. Date: Nov. 11, 2010

(65) Prior Publication Data

US 2012/0108101 A1 May 3, 2012

(30) Foreign Application Priority Data

May 6, 2009 (CN) ..... 2009 1 0302114

(51) Int. Cl.
*H01R 13/60* (2006.01)

(52) U.S. Cl.
USPC ..... 439/527

(58) Field of Classification Search
USPC ..... 439/527, 11, 640, 535–538, 241–243, 439/649–660, 214, 215, 21; 200/51 R; 174/53
See application file for complete search history.

(56) References Cited

U.S. PATENT DOCUMENTS 5,018,980 A * 5/1991 Robb ..... 439/8
6,854,768 B2 * 2/2005 Elder ..... 285/146.1

(Continued)

FOREIGN PATENT DOCUMENTS

CN 201066754 Y 5/2008
CN 201247894 Y 5/2009
CN 101562304 A 10/2009

OTHER PUBLICATIONS

International Search Report for International Application No. PCT/CN2010/072408 dated Aug. 12, 2010.

*Primary Examiner* — Edwin A. Leon
*Assistant Examiner* — Harshad Patel
(74) *Attorney, Agent, or Firm* — Kratz, Quintos & Hanson, LLP

(57) ABSTRACT

The invention relates to a movable connection method of a chain line type rotary socket and the rotary socket thereof. The rotary socket is as follows: a socket port is arranged on each rotary chain link, and a plurality of chain links are connected in series through rotary sleeves (1) to form a chain. Electrical appliance plug-in pieces (3) are arranged in all the chain links, the rotary sleeves (1) are hinged outside the chain links, conductors connected with the electrical appliance plug-in pieces (3) are arranged in the rotary sleeves (1) respectively, and the adjacent two chain links can rotate mutually. The structure of the rotary socket comprises the rotary chain links, conducting wires (6) and the electrical appliance plug-in pieces (3), wherein each rotary chain link comprises the rotary sleeve (1), end holes (13) are arranged at two ends of each rotary sleeve (1) respectively, the end holes (13) of the rotary sleeves (1) are lapped and combined sequentially to form a chain type structure, a base (5) and a cover plate (2), which act as a rotary shaft, are arranged in each end hole, and the electrical appliance plug-in pieces (3) and the conducting wires (6) are arranged in accommodating spaces formed by the bases (5), the cover plates (2) and the rotary sleeves (1). The socket is small in volume, convenient to carry and convenient to arrange.

18 Claims, 6 Drawing Sheets

U.S. PATENT DOCUMENTS

| | | | | |
|---|---|---|---|---|
| 8,118,616 | B1 * | 2/2012 | Clark | 439/640 |
| 8,157,574 | B2 * | 4/2012 | Hsiao | 439/131 |
| 8,262,399 | B1 * | 9/2012 | Zien et al. | 439/188 |
| 2005/0032396 | A1 * | 2/2005 | Huang | 439/11 |
| 2006/0094300 | A1 * | 5/2006 | Hsu et al. | 439/652 |
| 2006/0160377 | A1 * | 7/2006 | Huang | 439/31 |
| 2008/0305693 | A1 * | 12/2008 | Mei et al. | 439/701 |
| 2009/0011627 | A1 * | 1/2009 | Chien | 439/165 |
| 2012/0028505 | A1 * | 2/2012 | Weber et al. | 439/638 |

* cited by examiner

MOVABLE CONNECTION METHOD OF SOCKET AND ROTARY SOCKET THEREOF

TECHNICAL FIELD

The invention relates to the technical field of electrical appliance sockets, in particular to a chain link type socket movable connection method arranging socket port on each rotary body and a rotary socket thereof.

BACKGROUND OF THE INVENTION

In electrical appliance sockets, due to spatial position relationship of the placed sockets, a plurality of the sockets often occupy adjacent jacks and can not work simultaneously; furthermore, due to the mounting positions of the sockets on the wall, three-phase single sockets can not work often during the process of being converted to multi-purpose sockets. There are many types of the sockets at present; such as the sockets with switches, the sockets with voltage protection devices, the sockets with retractable pins and the like, and the sockets can also adopt the rotatable form, thereby meeting the demands of different markets.

For example, application number ZL200410050956.9 discloses a rotary socket which is convenient to be mounted in a spatial narrow place and can flexibly adjust the plug-in connection position of a plug, a socket core comprises an insulating cassette mechanism sleeve connected with the bottom of a socket bottom box and an insulating cassette mechanism which is movably sheathed in the cassette mechanism sleeve and penetrates out of a socket cover, at least two rotatable conductive rotary sleeve and penetrates out of a socket cover, at least two rotatable conductive rotary pole pieces are overlapped and sheathed in the axial direction of the outer circumference of the section where the cassette mechanism is matched with the cassette mechanism sleeve at an interval in parallel, coaxial jacks are formed by passing through the rotary pole pieces from the axial direction of the cassette mechanism, a wiring spring leaf connected with a power supply conducting wire 6 is further arranged on the outer edge of each rotary pole piece, and the cassette mechanism component can rotate relative to the cassette mechanism sleeve. On the one hand, the structure is easy to cause interference of peripheral space when the plug is inserted, on the other hand, the rotation of conductive sheets is easy to generate electric spark.

For another example, the patent number ZL200420009731.4, the utility model discloses a rotary socket combination, which comprises an upper cover, a terminal group, a terminal seat and a lower cover, wherein at least one group of jacks are arranged on the top surface of the upper cover, and a cover gap is arranged on each side of two sides respectively; a terminal post is used for connecting with terminals respectively, the terminal post comprises a circuit, end pieces are extended out of the terminal post corresponding to all the terminals, and the end pieces are pivotally connected with all the terminals; the terminal seat comprises a member connected with all the terminal, the upper cover and an outer cover; and the lower cover is an arc-shaped sheet body, so that after the terminal seat is connected with the terminal group, the upper cover and the lower cover respectively, all the parts can conveniently rotate independently for adjusting the directions of jacks. For another example, the patent number 200720151914 discloses a series-connected rotary socket, which comprises a main socket, an electrical connecting plug is arranged at the front end of a housing, a first jack externally connected with a power supply is arranged at the back end surface of the main socket, as for more than one series-connected socket, a conductive insert blade which is in plug-in connection and electrical connection with the first jack of the main socket is arranged at the front end surface of the housing, the conductive insert blade is fixed on a circular base body, the inner side end of the conductive insert blade is positioned in the housing, each of the parts is connected with a conducting wire respectively, the conducting wires are electrically connected with a conductive sheet of the first jack, which is arranged at the back end surface of the series-connected socket, the series-connected socket is vertically arranged on the side surface of the first jack, and the like. The several structures are different from the structure of the invention.

SUMMARY OF THE INVENTION

The invention aims at solving the problem that a plurality of plugs can not work simultaneously due to limited spatial positions for placing sockets and provides a rotary socket, which is reasonable in structural design, adopts the chain type connection way with equal pitch or unequal pitches, and is small in volume, convenient to carry and flexible and changeable to use.

The technical scheme adopted for solving the technical problem is as follows:

A movable connection method of a socket is characterized in that a plurality of chain links are connected in series through rotary sleeves to form a chain, electrical appliance plug-in pieces are arranged in all the chain links, the rotary sleeves are hinged outside the chain links, conductors connected with the electrical appliance plug-in pieces are arranged in the rotary sleeves respectively, and the adjacent two chain links can rotate mutually.

Preferentially, a sufficient space for accommodating the conductor is arranged in each rotary sleeve, and each conductor has the sufficient length so as to ensure that each conductor can not be tightened when the rotation between the two chain links reaches the maximal angle.

Preferentially, the maximal rotation angle between each rotary sleeve and the corresponding chain link is 120 degrees.

A rotary socket comprising the rotary chain links, conducting wires and the electrical appliance plug-in pieces, is characterized in that each rotary chain link comprises the rotary sleeve, end holes are arranged at two ends of each rotary sleeve respectively, the end holes of a plurality of the rotary sleeves are lapped and combined sequentially to form a chain type structure, a base and a cover plate, which act as a rotary shaft, are arranged in each end hole, and the electrical appliance plug-in pieces and the conducting wires are arranged in accommodating spaces formed by the bases, the cover plates and the rotary sleeves. The end holes of the rotary sleeves are hinged on combined structures of the bases and the cover plates, each rotary sleeve can rotate relative to the base and the cover plate, one end hole of the first rotary sleeve is aligned with one end hole of the second rotary sleeve, the other end hole of the second rotary sleeve is aligned with one end hole of the third rotary sleeve, and the combination is performed in such a way.

Preferentially, rotary rings are arranged on the hole circumferences of the two end holes of each rotary sleeve, the rotary rings are arranged on the same side surface of each rotary sleeve, and gaps are arranged in the positions where the two rotary rings are opposite in each rotary sleeve. The gaps are used for enabling the conducting wires to penetrate out and providing activity spaces for the conducting wires when the rotary sleeves rotate.

Preferentially, each rotary sleeve is in the shape of 8, a ring edge is arranged on the periphery of the shape of 8, the ring edge and the rotary rings are arranged on the same side, the ring edge and the rotary rings form a rotary wire groove, and the conducting wires are arranged in the rotary wire grooves. The grooves for enabling the conducting wires to pass through are the smooth groove surfaces based on the principle of not damaging the conducting wires, the conducting wires penetrate out of the gaps of the rotary rings and are used for connecting the electrical appliance plug-in pieces in the end holes, and a certain length is reserved in each rotary wire groove so as to prevent tightening during rotation.

Preferentially, the radian of the gap on each rotary ring is 120 degrees. The gaps are used for enabling the conducting wires to pass through and allowing the conducting wires to slide in the gaps, when the conducting wires need certain length allowance when sliding in the rotary sleeves, the radian of 120 degrees can enable each rotary sleeve to have the rotation amount of 60-degree angle to the left and the right relative to the cover plate and the base.

Preferentially, a cylinder body is arranged on the bottom surface of each cover plate, the outer diameter of each cylinder body is in adaption with the inner diameter of the end hole, the height of each cylinder body is greater than the length of the longest plug-in piece in the electrical appliance plug-in pieces, two groove notches are formed by removing two ⅓ blocks in symmetrical positions of each cylinder body, the groove gaps correspond to the gaps on the rotary rings, a cylindrical ring body is arranged on the upper surface of each base, and the inner diameter of each cylindrical ring body is in clearance fit with the outer diameter of the cylinder body. When in mounting, two layers of the rotating sleeves are fixed between the cover plate and the base, the cylinder body of the cover plate is clamped onto the cylindrical ring body of the base for alignment, and the cylinder body penetrates the end holes of each rotary sleeve as a rotary shaft of the rotary sleeves.

Preferentially, a fastening screw hole is arranged at the center of the cover plate, plug holes are formed between the fastening screw hole and the cylinder body, a screw hole rod corresponding to the fastening screw hole is arranged at the center of the base, a plurality of electrical appliance plug-in piece seats are arranged between the screw hole rod and the cylindrical ring body, and the electrical appliance plug-in piece seats are in one-to-one correspondence with the plug holes. As another scheme, the fastening screw holes can be set to be more than two, and the screw hole rods correspond to the fastening, screw holes.

Preferentially, the cover plate and the base are circular, a turned-over edge is arranged on the circumference, and the outer diameter of the turned-over edge is equal to the outer diameter of the circular ring edge at two ends of the shape of 8 of each rotary sleeve.

Preferentially, the rotary socket further comprises a rotary cover matched with each rotary sleeve, the rotary cover is in the shape of an 8-shaped thin sheet, and holes matched with the end holes are arranged at two ends of each rotary cover. When the rotary sleeves are assembled into the rotary socket in the chain type structure, each rotary sleeve is equipped with the rotary cover, and the rotary covers can seal the rotary wire grooves of the rotary sleeves so as to completely conceal the conducting wires between the rotary sleeves and the rotary covers.

Preferentially, one end hole of the first-link rotary sleeve in the chain type structure assembled by the rotary sleeves is a fixed part, and a power cord inlet port, a fuse tube, a power supply switch and an indicator lamp are arranged at the part of the end hole. In the embodiment, the first-link rotary sleeve is used as the connection-in point of a power supply, and a circuit safety element is arranged and mounted.

Therefore, the structural design is reasonable, the occupied volume is small, the carrying is convenient, each rotary sleeve can rotate, the minimal included angle between the two rotary sleeves is 60 degree, the arrangement is convenient, and the rotary socket capable of enabling a plurality of sockets to work without hindrance is realized.

BRIEF DESCRIPTION OF THE DRAWINGS

In combination of the figures and the embodiment, the invention is further described as follows.

In the figures: 1) rotary sleeve; 11) rotary ring; 12) rotary wire groove; 13) end hole; 14) ring edge; 15) gap; 15) convex block of rotary sleeve; 2) cover plate; 21) groove gap; 22) plug hole; 23) fastening screw hole; 3) electrical appliance plug-in piece; 31) wire inlet end; 32) wire outlet end; 33) insert piece; 4) wire inlet of power cord; 5) base; 51) screw hole rod; 52) cylindrical ring body; 53) electrical appliance plug-in piece seat; 6) conducting wire; 7) rotary cover; 71) convex block of rotary table; 8) switch; and 9) indicator lamp.

DETAILED DESCRIPTION OF THE INVENTION

In combination of the figures, the technical scheme of the invention is further specifically described through the following embodiments.

Figure 1:
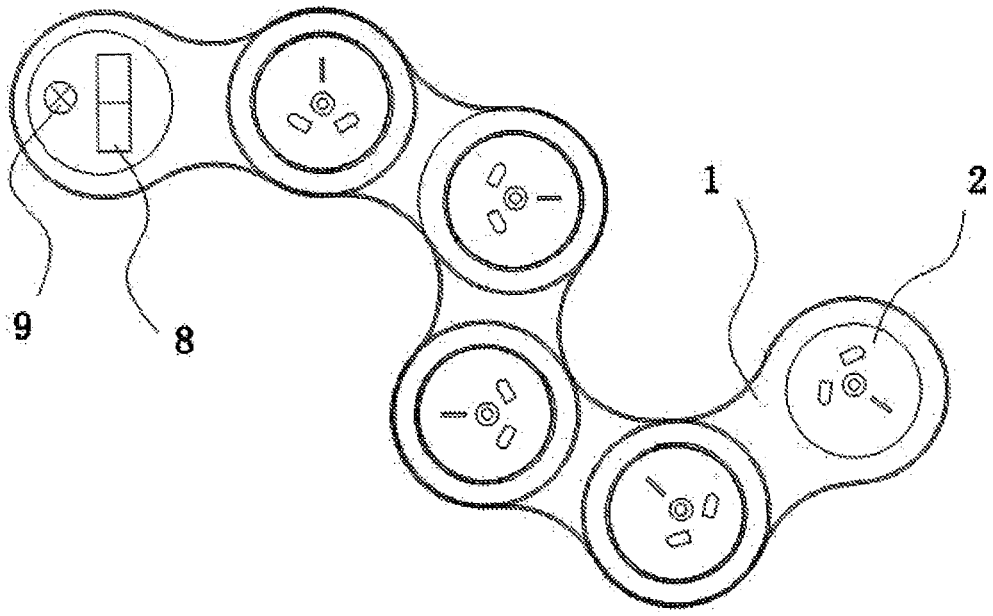
FIG. 1 is a schematic diagram of structure of one combination embodiment of the invention.
Figure 2:
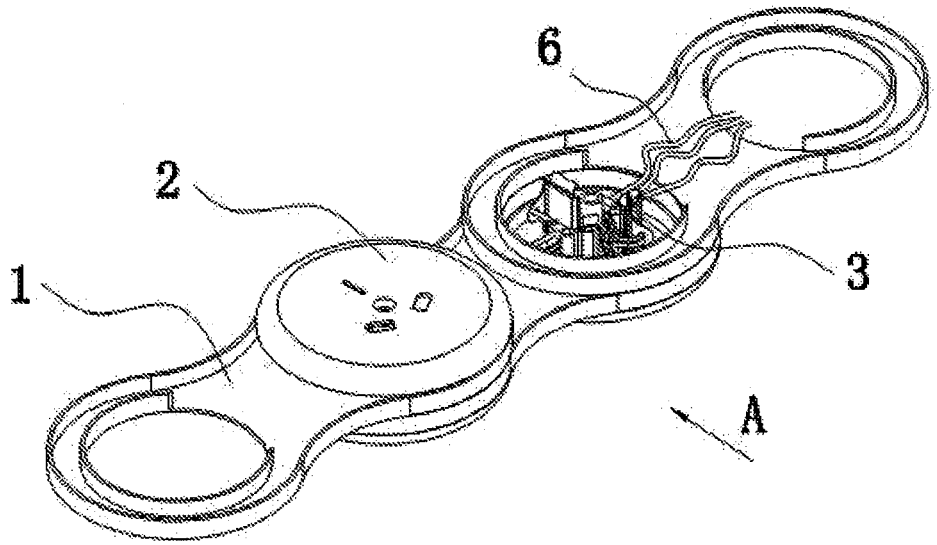
FIG. 2 is a schematic diagram of three-dimensional structure of partial section view of the invention.
Figure 3:
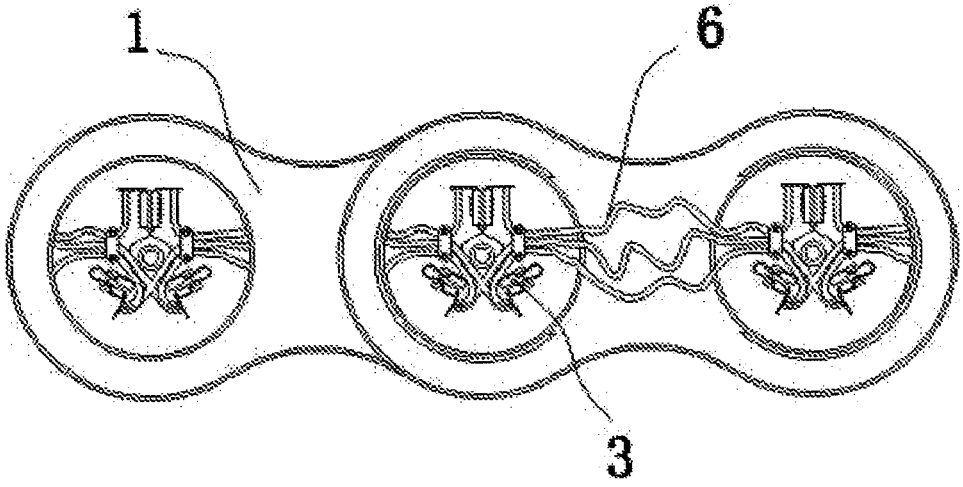
FIG. 3 is a schematic diagram of connecting structure of conducting wires.
Figure 4:
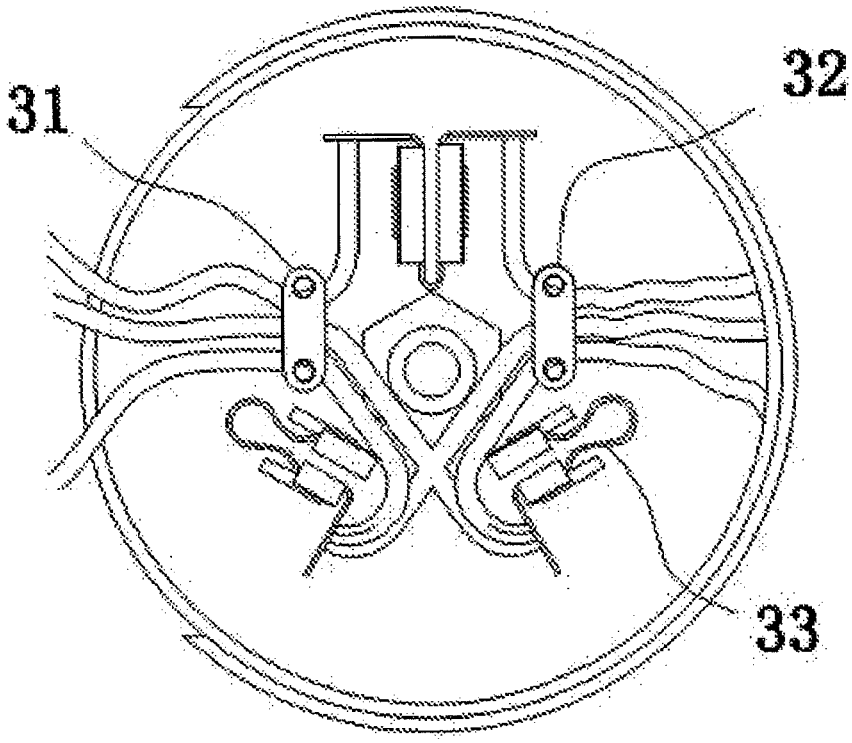
FIG. 4 is a schematic diagram of structure of electrical appliance plug-in piece on single chain link.
Figure 5:
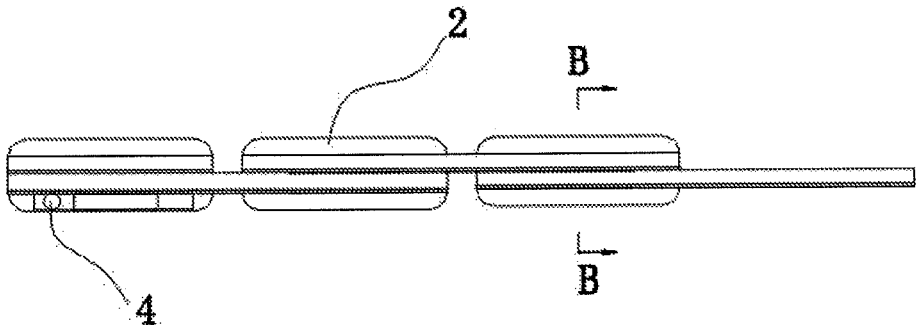
FIG. 5 is a schematic diagram of A-direction structure of FIG. 2 of the invention.
Figure 6:
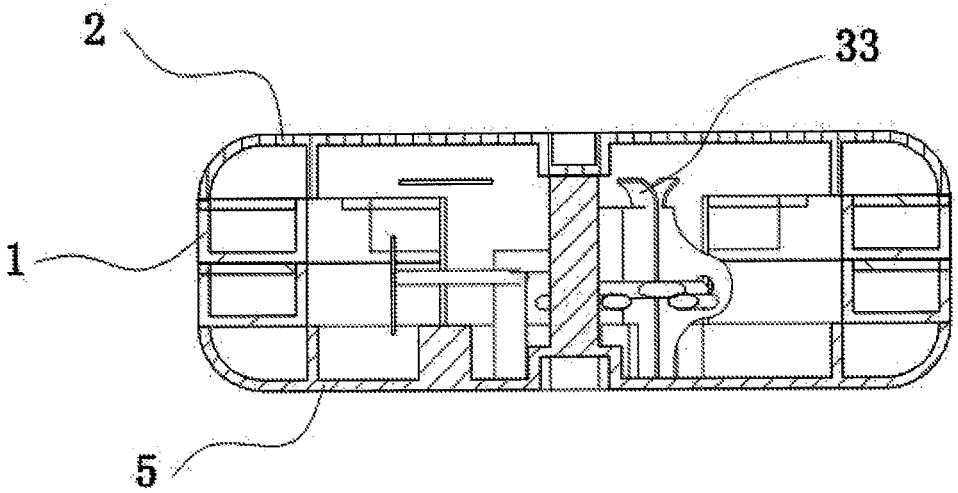
FIG. 6 is a schematic diagram of B-B section view of FIG. 5.
Figure 7:
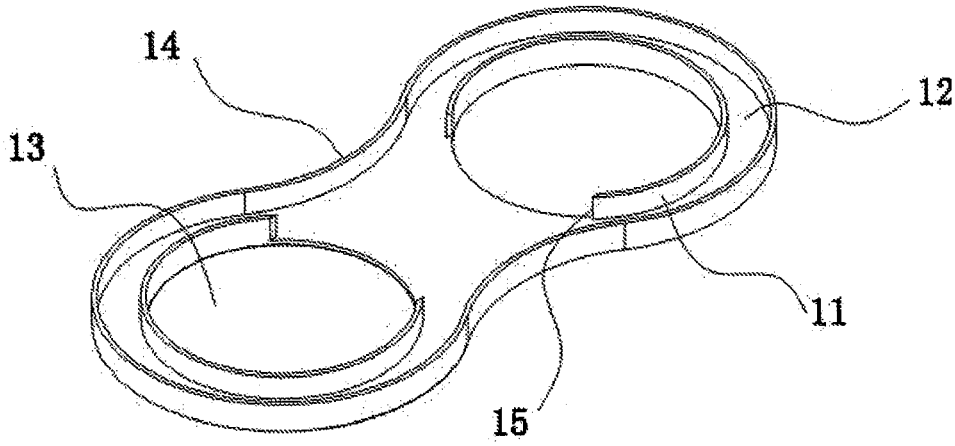
FIG. 7 is a schematic diagram of structure of rotary sleeve.

Embodiment 1: refer to FIG. 1, FIG. 2 and FIG. 7, a rotary socket comprises rotary chain links, conducting wires 6 and electrical appliance plug-in pieces 3, wherein each rotary chain link comprises a rotary sleeve 1, each rotary sleeve is designed into the shape of 8, a ring edge 14 is arranged on the periphery of the shape of 8, end holes 13 for enabling each rotary body to rotate are arranged at big holes at two ends of 8, rotary rings 11 are arranged on the same side of the two end holes 13 and the ring edge 14, gaps 15 are arranged in the positions where the two rotary rings 11 are opposite, the ring edge 14 and the rotary rings 11 constitute a rotary wire groove 12, and the electrifying conducting wires 6 are arranged in the rotary wire grooves 12.

Refer to FIG. 3, FIG. 4, FIG. 5 and FIG. 6, one end hole 13 of one rotary sleeve 1 is in mutual back-direction combination with one end hole 13 of another rotary sleeve 1, the other end hole is combined with one end hole of the third rotary sleeve for forming a chain type structure, different links from 3 to 16 can be connected in such a way, a base 5 and a cover plate 2 are arranged in each end hole, the electrical appliance plug-in pieces 3, the conducting wires 6 and other electrical appliance connecting pieces are arranged in accommodating spaces constituted by the bases, the cover plates and the rotary sleeves 1, then each rotary sleeve is divided into an upper layer and a lower layer, one layer is used for wire inlet, the other layer is used for wire outlet, and the electrical appliance plug-in pieces 3 can be set into two-phase or three-phase insert pieces according to needs, the three-phase insert pieces 33 are adopted in the embodiment, the three-phase insert pieces comprise a live wire insert piece, a neutral wire insert piece and a grounding insert piece, the wire outlet end 31 of the electrical appliance plug-in piece of the previous chain link is connected with the wire inlet end 32 of the electrical appliance plug-in piece of the next chain link through the conducting wire 6, and the conducting wires 6 pass through in the rotary wire grooves 12 of the rotary sleeves 1.

Refer to FIG. 1, the part of the first end hole 13 the first-link rotary sleeve 1 in the chain type structure assembled by the rotary sleeves 1 is a fixed part, a rotary mechanism part is not arranged, a power cord inlet port 4 is arranged at the side end of the part, a power supply switch 8 and an indicator lamp 9 are arranged on the cover plate, a fuse tube is arranged in the end hole and the like.

Figure 8:
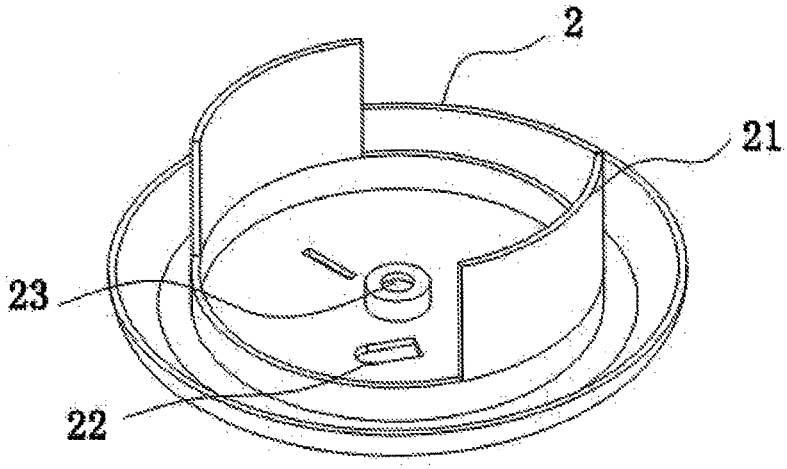
FIG. 8 is a schematic diagram of structure of cover plate.

As shown in FIG. 8, the cover plate 2 is circular, a turned-over edge is arranged on the circumference, and the outer diameter of the turned-over edge is equal to the outer diameter of the circular ring edge 14 at two ends of the shape of 8 of each rotary sleeve 1; a cylinder body is further arranged on the inner side of the turned-over edge on the circumference of the cover plate 2, the height of each cylinder body is greater than the length of the longest plug-in piece, namely the insert piece 33, in the electrical appliance plug-in pieces 3, the outer diameter of the cylinder body is matched with the aperture of the end hole 13, two groove notches 21 are formed by removing two ⅓ blocks in symmetrical positions of each cylinder body, and the groove gaps 21 correspond to the gaps 15 on the rotary rings 11 so as to enable the conducting wires 6 to pass through during rotation; and a fastening screw hole 23 is arranged at the center of the cover plate 2, plug holes 22 are formed between the fastening screw hole 23 and the cylinder body, and three-phase jacks are formed in the embodiment.

Figure 9:
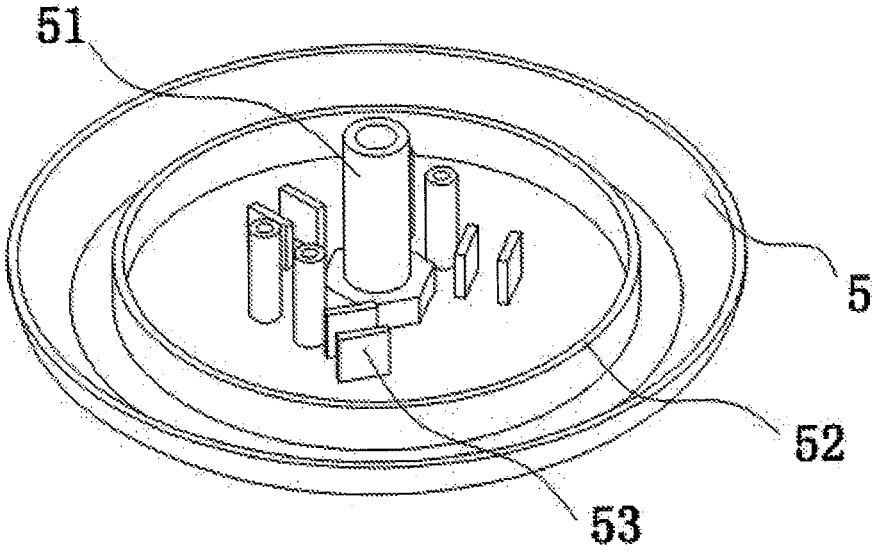
FIG. 9 is a schematic diagram of structure of base.

Refer to FIG. 9, a circular base 5 with the equivalent outer diameter with the cover plate 2 is arranged, the turned-over edge is also arranged on the outer edge of a circle, the cover plate 2 and the base 5 have the equivalent outer diameter with the circular ring edge 14 at two ends of the shape of 8, and the cover plate 2 and the base 5 simultaneously penetrate the end holes 13 of the two rotary sleeves 1 after assembly and act as a rotary shaft of the rotary sleeves 1, thereby constituting the rotary body which can rotate a certain angle.

Figure 10:
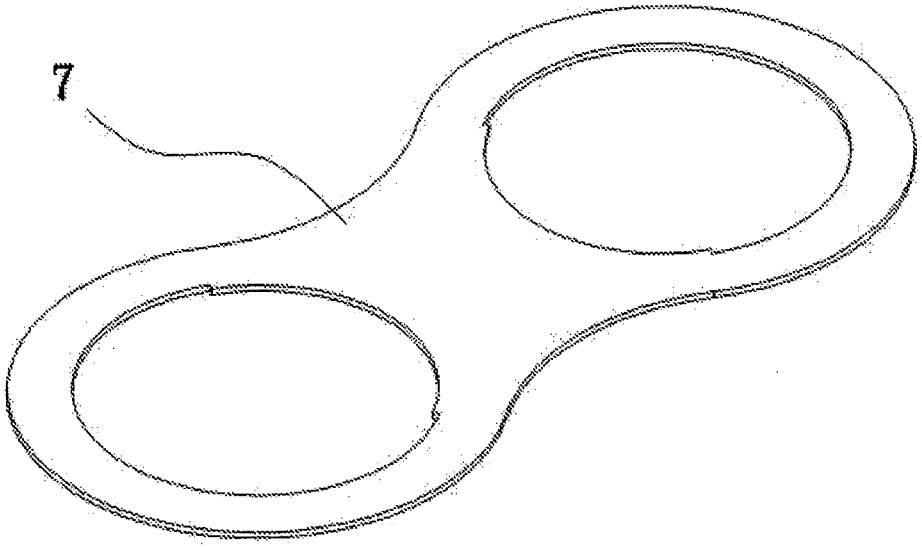
FIG. 10 is a schematic diagram of structure of rotary cover.

A cylindrical ring body 52 is processed on the inner side of the circular turned-over edge of the base 5, the height of the cylindrical ring body 52 is lower than the circular turned-over edge of the outer ring, and the inner diameter of the cylindrical ring body 52 is in clearance fit with the outer diameter of the cylinder body with the groove gaps 21 in the cover plate 2; a screw hole rod 51 is arranged in the central position of the base 5, the space after the screw hole rod 51 is connected with the cover plate 2 is sufficient to contain the electrical appliance plug-in piece 3, and the space is determined according to standards; and three electrical appliance plug-in piece seats 53 are arranged between the screw hole rod 51 and the cylindrical ring body 52, the electrical appliance plug-in piece seats 53 correspond to the plug holes 22, and the electrical appliance plug-in piece seats 53 are used for positioning the insert pieces 33. In order to close all the conducting wires 6, a rotary cover 7 is equipped on each rotary sleeve 1, as shown in FIG. 10, the small turned-over edge is arranged on the periphery of each rotary cover 7 so as to form a box cover with the rotary sleeve 1, and the gaps are also left in the positions for enabling the conducting wires 6 to pass and rotate, thereby facilitating the movement of the conducting wires 6.

Figure 11:
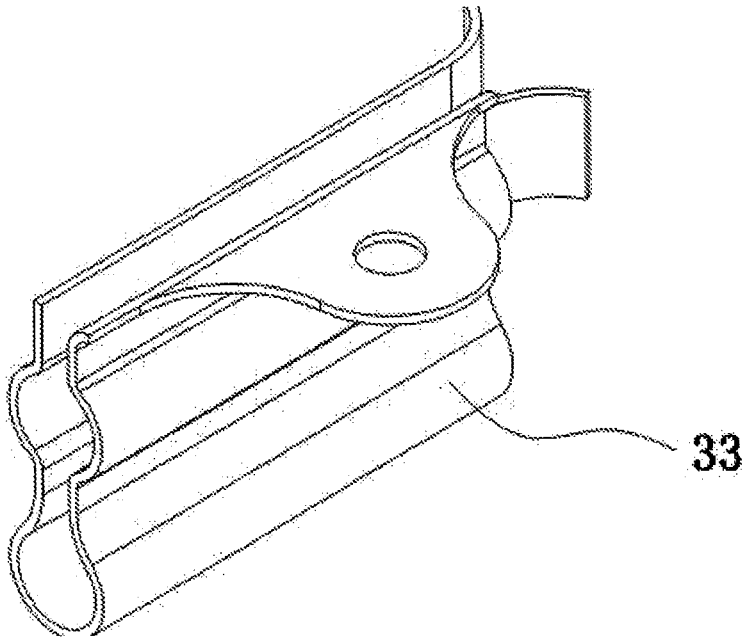
FIG. 11 is a schematic diagram of structure of embodiment of live wire insert piece.

The structural forms of the insert pieces 33 can be variable and be changed according to different local standards, the live wire copper piece and the grounding copper piece are different, and the embodiment of the structure of the live wire insert piece is shown in FIG. 11.

During working, different socket chain links from 3-16 can be mutually combined, the chain links can rotate ±60 degrees in the horizontal direction (keeping socket holes upward), the minimal included angle between the two rotary sleeves 1 can achieve 60 degrees, and the socket holes on the cover plates can be designed into three-phase or two-phase or combination of the two according to actual needs, thereby realizing random rotation, occupying few spatial positions, being convenient to use, and preventing mutual interference of the two socket holes.

Figure 12:
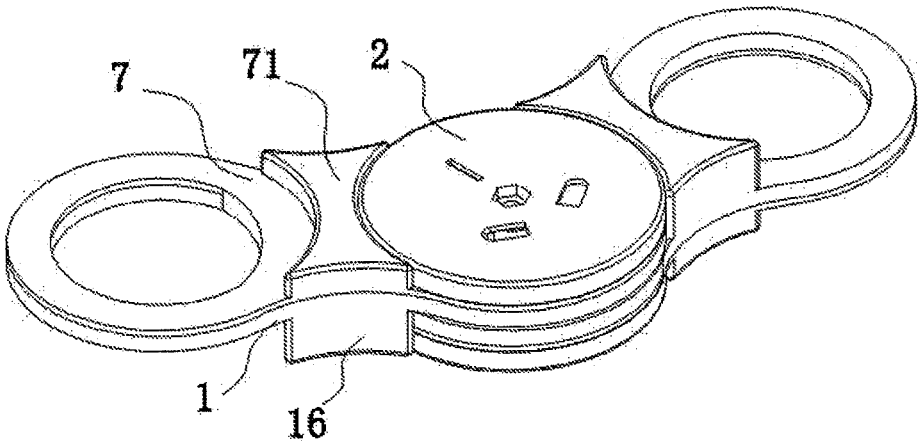
FIG. 12 is a schematic diagram of structure of the second structure of the invention.

Embodiment 2: refer to FIG. 12, in a rotary socket, a convex block 16 of the rotary sleeve is arranged on the outer side surface between the two end holes 13 of each rotary sleeve 16, the top surface of the convex block 16 of the rotary sleeve is flush with the end surface of the cover plate 2 or the base, the side edge of the convex block 16 of the rotary sleeve, which is opposite to the end hole 13 is an arc-shaped edge matched with the circumference of the cover plate 2, and the other two side edges of the convex block 16 of the rotary sleeve are flushed with the side edge of the rotary sleeve 1. The convex block 71 of the rotary cover is arranged on the outer side surface of the rotary cover 7, the side edge of the convex block 71 of the rotary cover is flush with the convex block 16 of the rotary sleeve, and the top surface of the convex block 71 of the rotary cover is flush with the end surface of the cover plate 2 or the base.

Other structures in the embodiment are the same with those in the embodiment 1.

The above embodiments are used for describing the invention rather than limiting the invention, and the structures obtained by performing any simple changes on the invention still belong to the protection range of the invention.

What is claimed is:

1. A rotary socket comprising rotary chain links, conducting wires and electrical appliance plug-in pieces, characterized in that each rotary chain link comprises a rotary sleeve (1), end holes (13) arranged at two ends of each rotary sleeve (1) respectively, the end holes (13) of a plurality of each rotary sleeves (1) are lapped and combined sequentially to form a chain type structure, a base (5) and a cover plate (2), which act as a rotary shaft, arranged in each end hole, and the electrical appliance plug-in pieces (3) and the conducting wires (6) are arranged in accommodating spaces formed by the bases (5), the cover plates (2) and the rotary sleeves (1), and characterized in that rotary rings (11) are arranged on the hole circumferences of the two end holes (13) of each rotary sleeve, the rotary rings (11) are arranged on the same side surface of each rotary sleeve (1), and gaps (15) are arranged in the positions where the two rotary rings (11) are opposite.

2. The rotary socket according to claim 1, characterized in that the radian of the gap (15) on each rotary ring (11) is 120 degrees.

3. The rotary socket according to claim 2, characterized in that the cover plate (2) and the base are circular, a turned-over edge is arranged on the circumference, and the outer diameter of the turned-over edge is equal to the outer diameter of the circular ring edge (14) at two ends of the shape of 8 of each rotary sleeve (1).

4. The rotary socket according to claim 2, characterized in that the rotary socket further comprises a rotary cover (7) matched with each rotary cover (1), the rotary cover (7) is in the shape of an 8-shaped thin sheet, and holes matched with the end holes (13) are arranged at two ends of each rotary cover (7).

5. The rotary socket according to claim 2, characterized in that one end hole of the first-link rotary sleeve (1) in the chain type structure assembled by each rotary sleeves (1) is a fixed part, and a power cord inlet port (4), a fuse tube, a power supply switch (8) and an indicator lamp (9) are arranged at the part of the end hole (13).

6. The rotary socket according to claim 1, characterized in that each rotary sleeve (1) is in the shape of 8, a ring edge (14) is arranged on the periphery of the shape of 8, the ring edge (14) and the rotary rings (11) are arranged on the same side, the ring edge (14) and the rotary rings (11) form a rotary wire groove (12), and the conducting wires (6) are arranged in the rotary wire grooves (12).

7. The rotary socket according to claim 1, characterized in that the cover plate (2) and the base are circular, a turned-over edge is arranged on the circumference, and the outer diameter of the turned-over edge is equal to the outer diameter of the circular ring edge (14) at two ends of the shape of 8 of each rotary sleeve (1).

8. The rotary socket according to claim 2, characterized in that the rotary socket further comprises a rotary cover (7) matched with each rotary cover (1), the rotary cover (7) is in the shape of an 8-shaped thin sheet, and holes matched with the end holes (13) are arranged at two ends of each rotary cover (7).

9. The rotary socket according to claim 1, characterized in that one end hole of the first-link rotary sleeve (1) in the chain type structure assembled by each rotary sleeves (1) is a fixed part, and a power cord inlet port (4), a fuse tube, a power supply switch (8) and an indicator lamp (9) are arranged at the part of the end hole (13).

10. A rotary socket comprising rotary chain links, conducting wires and electrical appliance plug-in pieces, characterized in that each rotary chain link comprises a rotary sleeve (1), end holes (13) arranged at two ends of each rotary sleeve (1) respectively, the end holes (13) of a plurality of each rotary sleeves (1) are lapped and combined sequentially to form a chain type structure, a base (5) and a cover plate (2), which act as a rotary shaft, arranged in each end hole, and the electrical appliance plug-in pieces (3) and the conducting wires (6) are arranged in accommodating spaces formed by the bases (5), the cover plates (2) and the rotary sleeves (1), and characterized in that each rotary sleeve (1) is in the shape of 8, a ring edge (14) is arranged on the periphery of the shape of 8, the ring edge (14) and the rotary rings (11) are arranged on the same side, the ring edge (14) and the rotary rings (11) form a rotary wire groove (12), and the conducting wires (6) are arranged in the rotary wire grooves (12).

11. A rotary socket comprising rotary chain links, conducting wires and electrical appliance plug-in pieces, characterized in that each rotary chain link comprises a rotary sleeve (1), end holes (13) arranged at two ends of each rotary sleeve (1) respectively, the end holes (13) of a plurality of each rotary sleeves (1) are lapped and combined sequentially to form a chain type structure, a base (5) and a cover plate (2), which act as a rotary shaft, arranged in each end hole, and the electrical appliance plug-in pieces (3) and the conducting wires (6) are arranged in accommodating spaces formed by the bases (5), the cover plates (2) and the rotary sleeves (1), and characterized in that a cylinder body is arranged on the bottom surface of each cover plate, the outer diameter of each cylinder body is in adaption with the inner diameter of the end hole, the height of each cylinder body is greater than the length of the longest plug-in piece in the electrical appliance plug-in pieces (3), two groove notches (21) are formed by removing two ⅓ blocks in symmetrical positions of each cylinder body, the groove gaps (21) correspond to the gaps (15) on the rotary rings (11), the cylindrical ring body (52) is arranged on the upper surface of each base (5), and the inner diameter of each cylindrical ring body (52) is in clearance fit with the outer diameter of the cylinder body.

12. The rotary socket according to claim 11, characterized in that a fastening screw hole (23) is arranged at the center of each cover plate (2), plug holes (22) are formed between the fastening screw hole (23) and the cylinder body, a screw hole rod (51) corresponding to the fastening screw hole (23) is arranged at the center of the base (5), a plurality of electrical appliance plug-in piece seats are arranged between the screw hole rod (51) and the cylindrical ring body (52), and electrical appliance plug-in piece seats (53) are in one-to-one correspondence with the plug holes (22).

13. The rotary socket according to claim 11, characterized in that the cover plate (2) and the base are circular, a turned-over edge is arranged on the circumference, and the outer diameter of the turned-over edge is equal to the outer diameter of the circular ring edge (14) at two ends of the shape of 8 of each rotary sleeve (1).

14. The rotary socket according to claim 11, characterized in that the rotary socket further comprises a rotary cover (7) matched with each rotary cover (1), the rotary cover (7) is in the shape of an 8-shaped thin sheet, and holes matched with the end holes (13) are arranged at two ends of each rotary cover (7).

15. The rotary socket according to claim 11, characterized in that one end hole of the first-link rotary sleeve (1) in the chain type structure assembled by each rotary sleeves (1) is a fixed part, and a power cord inlet port (4), a fuse tube, a power supply switch (8) and an indicator lamp (9) are arranged at the part of the end hole (13).

16. A rotary socket comprising rotary chain links, conducting wires and electrical appliance plug-in pieces, characterized in that each rotary chain link comprises a rotary sleeve (1), end holes (13) arranged at two ends of each rotary sleeve (1) respectively the end holes (13) of a plurality of each rotary sleeves (1) are lapped and combined sequentially to form a chain type structure, a base (5) and a cover plate (2), which act as a rotary shaft, arranged in each end hole, and the electrical appliance plug-in pieces (3) and the conducting wires (6) are arranged in accommodating spaces formed by the bases (5), the cover plates (2) and the rotary sleeves (1), and characterized in that the cover plate (2) and the base are circular, a turned-over edge is arranged on the circumference, and the outer diameter of the turned-over edge is equal to the outer diameter of the circular ring edge (14) at two ends of a shape of 8 of each rotary sleeve (1).

17. A rotary socket comprising rotary chain links, conducting wires and electrical appliance plug-in pieces, characterized in that each rotary chain link comprises a rotary sleeve (1), end holes (13) arranged at two ends of each rotary sleeve (1) respectively, the end holes (13) of a plurality of each rotary sleeves (1) are lapped and combined sequentially to form a chain type structure, a base (5) and a cover plate (2), which act as a rotary shaft, arranged in each end hole, and the electrical appliance plug-in pieces (3) and the conducting wires (6) are arranged in accommodating spaces formed by the bases (5), the cover plates (2) and the rotary sleeves (1), and characterized in that the rotary socket further comprises a rotary cover (7) matched with each rotary cover (1), the rotary cover (7) is in a shape of an 8-shaped thin sheet, and holes matched with the end holes (13) are arranged at two ends of each rotary cover (7).

18. A rotary socket comprising rotary chain links, conducting wires and electrical appliance plug-in pieces, characterized in that each rotary chain link comprises a rotary sleeve (1), end holes (13) arranged at two ends of each rotary sleeve (1) respectively, the end holes (13) of a plurality of each rotary sleeves (1) are lapped and combined sequentially to form a chain type structure, a base (5) and a cover plate (2), which act as a rotary shaft, arranged in each end hole, and the electrical appliance plug-in pieces (3) and the conducting wires (6) are arranged in accommodating spaces formed by the bases (5), the cover plates (2) and the rotary sleeves (1), and characterized in that one end hole of the first-link rotary sleeve (1) in the chain type structure assembled by each rotary sleeves (1) is a fixed part, and a power cord inlet port (4), a fuse tube, a power supply switch (8) and an indicator lamp (9) are arranged at the part of the end hole (13).

* * * * *